US007073812B2

(12) United States Patent
Rigal et al.

(10) Patent No.: US 7,073,812 B2
(45) Date of Patent: Jul. 11, 2006

(54) ASSEMBLY FOR RETAINING A BOOT ON GLIDING BOARD

(75) Inventors: Jean-Pierre Rigal, Mesigny (FR); Jean-François Merino, Epagny (FR)

(73) Assignee: Salomon S.A., Metz-Tessy (FR)

( * ) Notice: Subject to any disclaimer, the term of this patent is extended or adjusted under 35 U.S.C. 154(b) by 49 days.

(21) Appl. No.: 10/630,662

(22) Filed: Jul. 31, 2003

(65) Prior Publication Data

US 2004/0113393 A1 Jun. 17, 2004

(30) Foreign Application Priority Data

Aug. 1, 2002 (FR) ..... 02 10119

(51) Int. Cl.
*A63C 9/00* (2006.01)

(52) U.S. Cl. ..... 280/611; 280/612; 280/626

(58) Field of Classification Search ..... None
See application file for complete search history.

(56) References Cited

U.S. PATENT DOCUMENTS

| | | | | |
|---|---|---|---|---|
| 3,776,566 A | | 12/1973 | Sholka | 280/11.35 H |
| 3,826,509 A | | 7/1974 | Sholka | 280/11.35 H |
| 4,121,854 A | | 10/1978 | Cornu | 280/612 |
| 4,160,555 A | | 7/1979 | Salomon | 280/612 |
| 4,191,395 A | | 3/1980 | Salomon | 280/613 |
| 4,280,714 A | * | 7/1981 | Salomon | 280/611 |
| 4,383,702 A | | 5/1983 | Salomon | 280/611 |
| 4,545,598 A | * | 10/1985 | Spitaler et al. | 280/612 |
| 4,589,673 A | * | 5/1986 | Dimier et al. | 280/630 |
| 4,607,859 A | * | 8/1986 | Wittmann et al. | 280/632 |
| 4,938,497 A | * | 7/1990 | Goud | 280/625 |
| 5,005,854 A | * | 4/1991 | Szafranski | 280/626 |
| 5,294,144 A | * | 3/1994 | Stepanek et al. | 280/612 |
| 5,743,550 A | * | 4/1998 | Frohwein | 280/612 |
| 6,659,494 B1 | * | 12/2003 | Martin | 280/612 |
| 6,769,711 B1 | * | 8/2004 | Martin et al. | 280/625 |

FOREIGN PATENT DOCUMENTS

| | | |
|---|---|---|
| EP | 0346414 | 12/1989 |
| FR | 2351678 | 12/1977 |
| FR | 2363343 | 3/1978 |
| FR | 2364045 | 4/1978 |
| FR | 2374922 | 7/1978 |
| FR | 2418657 | 9/1979 |
| WO | WO89/04701 | 6/1989 |

* cited by examiner

*Primary Examiner*—Christopher P. Ellis
*Assistant Examiner*—Christopher Bottorff
(74) *Attorney, Agent, or Firm*—Greenblum & Bernstein, P.L.C.

(57) ABSTRACT

An assembly for retaining a boot on a gliding board having a release block with at least one jaw for retaining a member for fastening the boot, the jaw being movable between a closed position in which it retains the fastening member and an open position in which it releases the fastening member, the jaw being maintained in the closed position by a movable latch. The movement of the latch is controlled by a source of pneumatic energy, with the exclusion of any other energy.

29 Claims, 5 Drawing Sheets

ASSEMBLY FOR RETAINING A BOOT ON GLIDING BOARD

CROSS-REFERENCE TO RELATED APPLICATION

This application is based upon French patent application No. 02.10119, filed Aug. 1, 2002, the disclosure of which is hereby incorporated by reference thereto in its entirety, and the priority of which is hereby claimed under 35 U.S.C. §119.

BACKGROUND OF THE INVENTION

1. Field of the Invention

The invention relates to an assembly for retaining a boot on a gliding board. In a particular embodiment, the invention relates to an assembly for retaining a boot on an alpine ski.

2. Description of Background and Relevant Information

In order to retain a boot on an alpine ski, one ordinarily uses retaining elements, i.e., bindings, that release the boot when the forces, or stresses, between the boot and the board exceed a predetermined threshold.

In a conventional manner, one uses assemblies that are completely mechanical for detecting such forces and for ensuring the release of the boot. For these types of assemblies, all of the energy required to cause the opening of the jaw is produced by the boot.

These assemblies have until now yielded positive results. Nevertheless, the processing that results from the detection of stresses is relatively limited. Generally, only an instantaneous stress is measured in a given direction, and this stress is used to cause the opening of the retaining jaw. In a conventional manner, one allows the jaw to displace itself against the return force of a spring, and the boot is released when it pushes the jaw beyond a predetermined position. Under these conditions, the boot is displaced with the jaw, which requires providing gliding surfaces between the boot and the retaining elements so as to control, as much as possible, the friction of the sliding of the boot with respect to its various supports or support surfaces. These constructional stresses make the boot uncomfortable for walking.

Studies have been conducted to detect stresses and to process the data electronically instead of mechanically. The detecting means or apparatus that are the most commonly proposed are stress gauges that are positioned in the connection between the boot and the ski. Various solutions for processing the electric signals are known that take into account both the duration and the intensity of the stresses detected. As for the member that causes the release of the boot, it has been proposed to use an electromagnetic or a pyrotechnic-type release device.

The published applications FR 2 351 678 and FR 2 374 922, and their family members, U.S. Pat. No. 4,160,555 and U.S. Pat. No. 4,383,702, respectively, describe a system for detecting and electronically processing stresses. The published application EP 0 346 414 describes an electromagnetic-type release, and the published application FR 2 364 045, and family member U.S. Pat. No. 4,121,854, describe a pyrotechnic-type release.

The drawback with an electromagnetic-type release is that it requires a substantial source of energy in order to provide sufficient energy to the electromagnet that controls the opening of the jaw. Additionally, it is difficult to control the phenomena of discharging the battery over time.

A pyrotechnic-type release is capable of providing a substantial instantaneous energy; however, the number of releases possible before recharging the system is completely limited.

Consequently, there is a need for a system for retaining a boot on a gliding board in which the energy source that controls the opening of the jaw is capable of providing a substantial energy under a light volume and loaded weight, and allows for a relatively substantial number of releases before requiring a recharge.

SUMMARY OF THE INVENTION

Thus, the invention provides for an assembly for retaining a boot on a gliding board having a release block that has at least one jaw for retaining a member for fastening the boot, the jaw being movable between a closed position in which it retains the fastening member and an open position in which it releases the fastening member, the jaw being maintained in a closed position by a movable latch. The movement of the latch is controlled by a source of pneumatic energy, with the exclusion of all other energy.

BRIEF DESCRIPTION OF DRAWINGS

The invention will be better understood with reference to the following description and the attached drawings relating thereto.

DETAILED DESCRIPTION OF THE INVENTION

Figure 1:
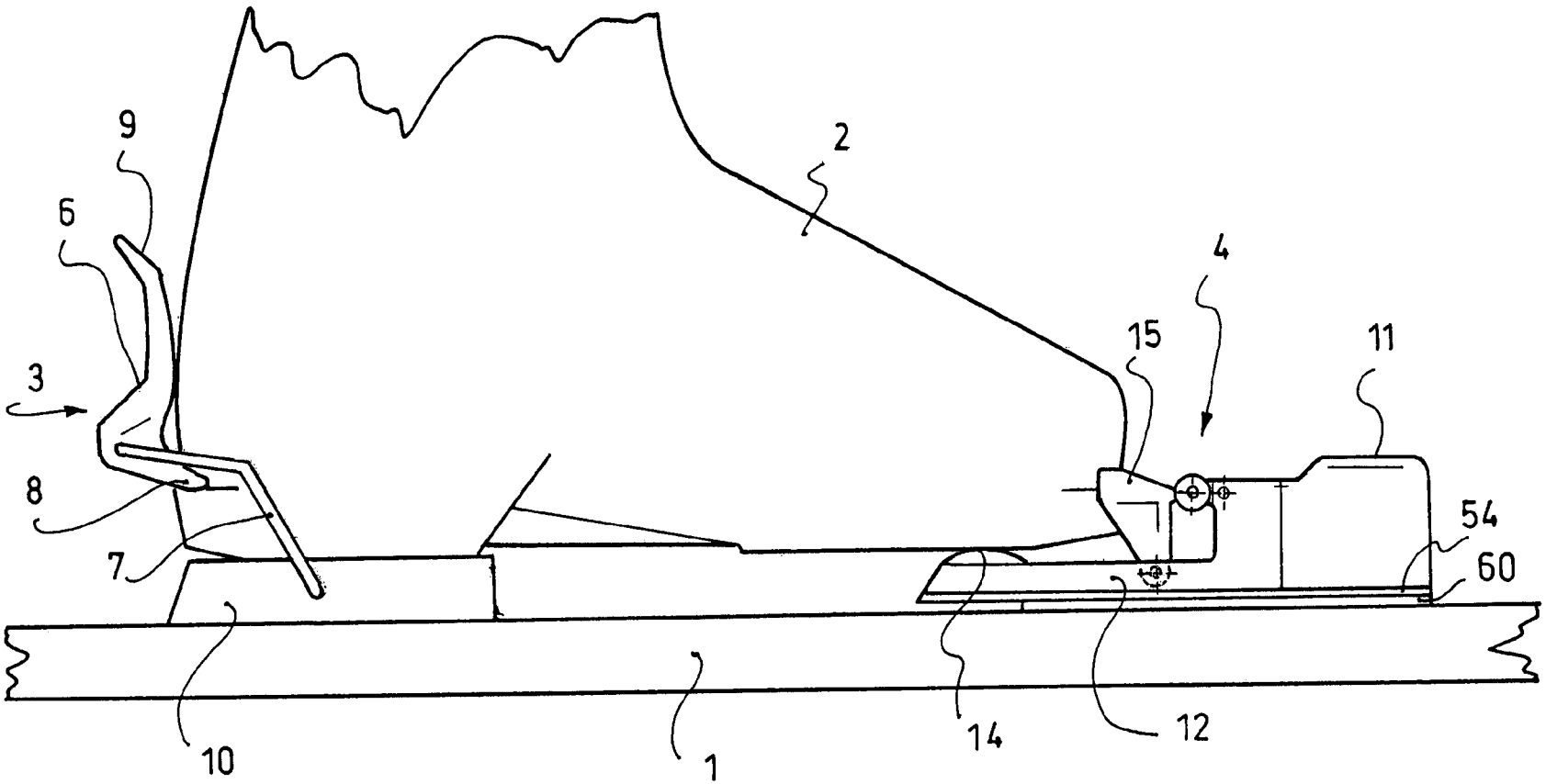
FIG. 1 is a general view of the device of the invention according to a non-limiting embodiment.

FIG. 1 shows the central portion 1 of a ski over which a boot 2 is positioned. The boot is retained on the ski by front and rear portions that are retained by rear 3 and front 4 retaining elements, or bindings.

According to the embodiment shown, the rear retaining element 3 has a rear retaining block 6 articulated with respect to a stirrup 7. The stirrup is mounted to pivot with respect to a rear plate 10 for supporting the rear portion of the boot. The rear plate 10 is affixedly attached to the ski by any appropriate means, for example, by screws, by gluing, or by welding. The rear retaining block 6 has a jaw 8 for retaining the boot and a control lever 9 affixed to the block for forcing the pivoting of the jaw between a position for retaining the rear end piece of the boot and a position for releasing this end piece. In FIG. 1, the retaining block is in a boot retaining position.

The construction of the rear element 3 is not limiting and other constructional embodiments can be used. For instance, instead of having a unitary jaw lever assembly, one could have two separate elements. Additionally, as mentioned below, the rear retaining block that here is non-releasable can be replaced by a releasable element ensuring the release of the boot beyond a predetermined threshold force.

The front retaining element 4 has a front retaining block 11 that will now be described, and a processing circuit that is described below.

The front retaining block has a lower plate 12. At the rear, the plate 12 has a support member 14 for supporting the boot. Because there is no displacement between the boot and its support member 14 before the boot is released, the support member 14 has no specific constructional stress. In particular, it is not necessary to provide an anti-friction material on the upper surface of the support member 14. Additionally, there is less constructional stress and material in the area of the boot.

A jaw 15 for retaining the front end of the boot is articulated with respect to the plate 12.

In FIGS. 3–6 the jaw 15 is shown as a unitary element having two lateral wings 16 and 17 for the lateral retention of the boot, and a sole clamp 18 for the vertical retention of the boot. The front retention of the boot is achieved by the lower portion of the jaw upon contact with the sole, or by the central portion of the sole clamp upon contact with the boot upper.

The base of the jaw 15 is articulated on the plate 12 about a transverse and horizontal axis 20, which can take the form of a pin or axle, for example, or other constructions for effecting the articulation. As shown, for instance, the base of the jaw has a reduced width, and the plate 12 has a depression or bore 22 within which the base of the jaw 15 is engaged. The axle 20 connects the base of the jaw 15 to the lateral sides of the depression 22.

Figure 2:
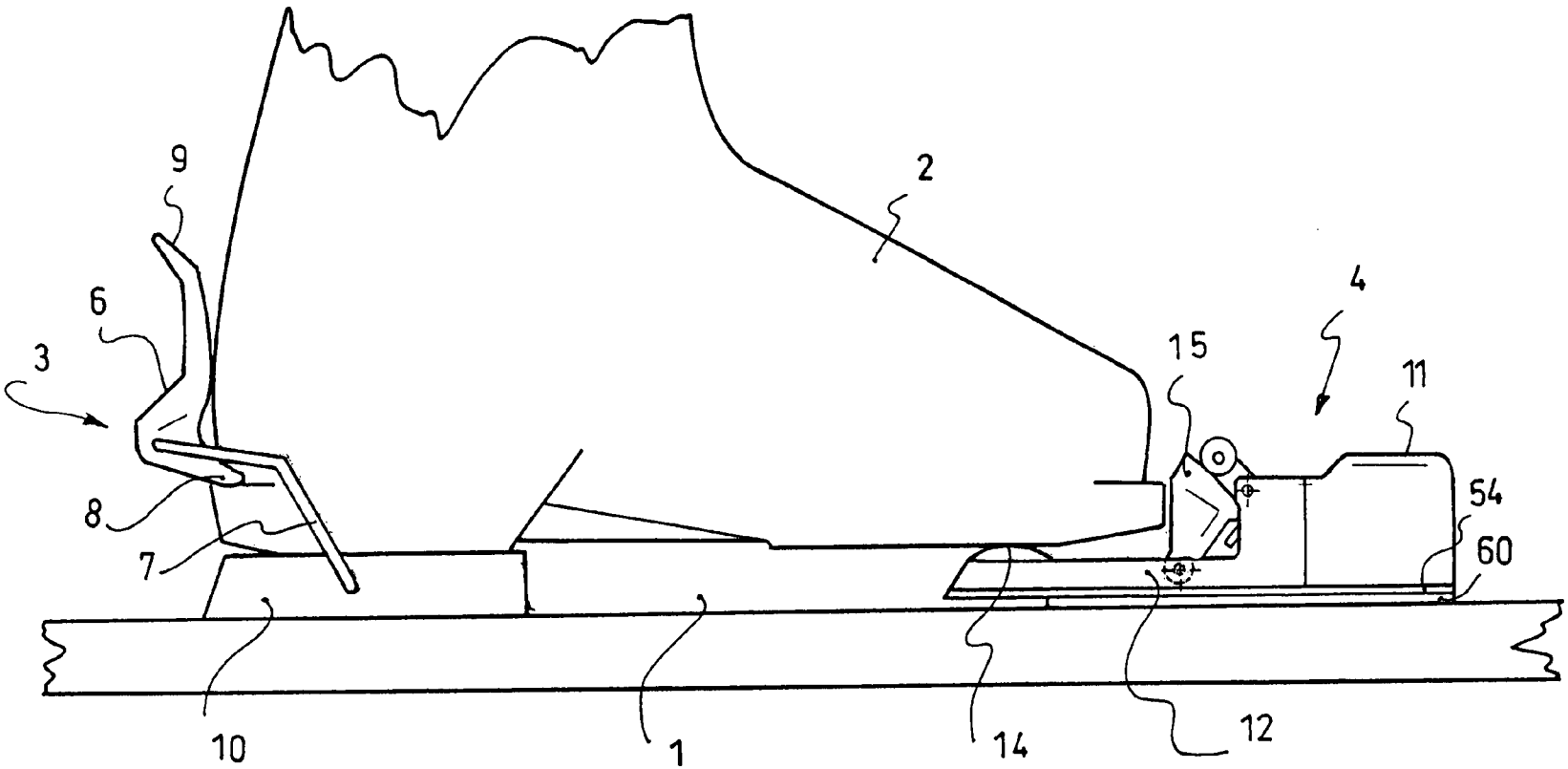
FIG. 2 shows the device of FIG. 1 in a boot releasing phase.
Figure 3:
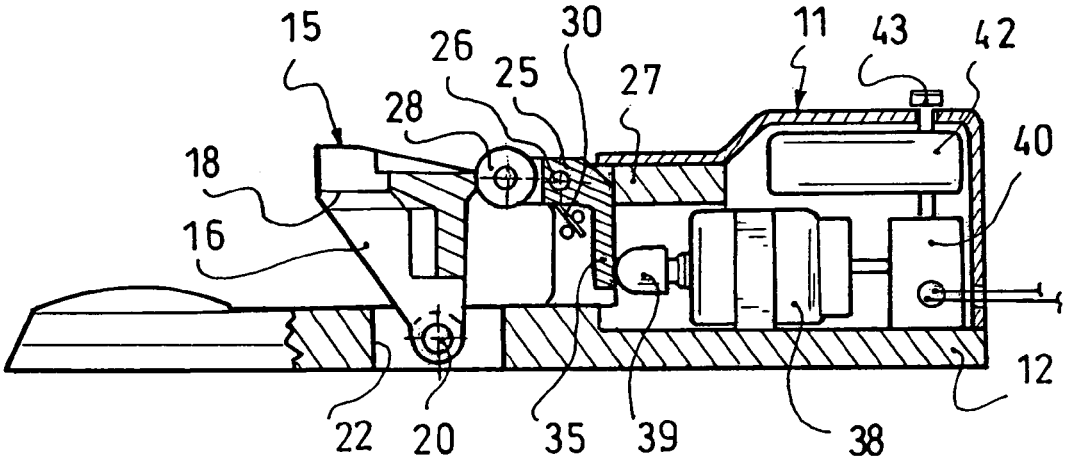
FIG. 3 is a side view in a partial cross-section of the releasing block.
Figure 4:
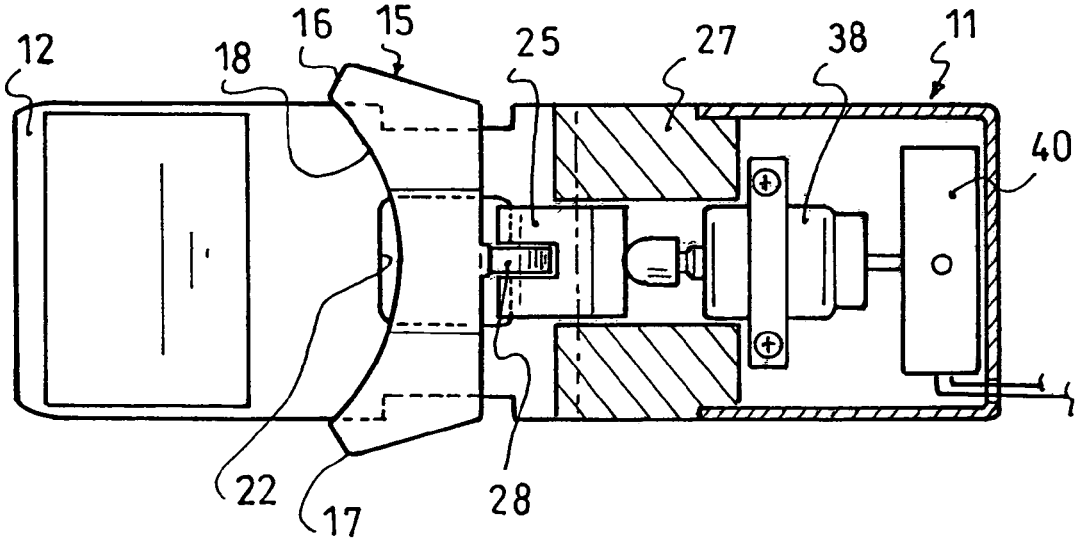
FIG. 4 is a top view and a partial cross-section of the block of FIG. 3.
Figure 6:
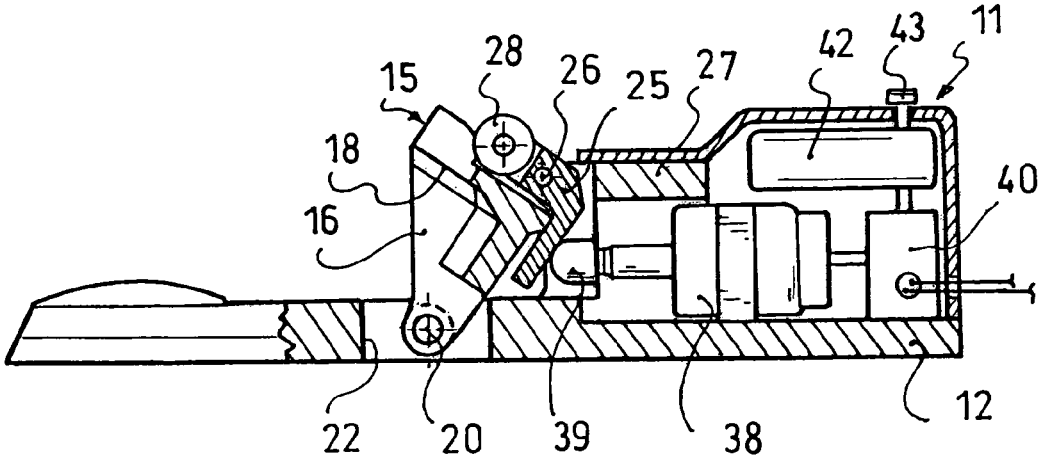
FIG. 6 shows the releasing block with the jaw open.

The dimensions of the depression/bore 22 along the longitudinal direction are determined so as to allow the jaw 15 to pivot freely between a retaining position in which the jaw 15 is adjusted vertically, the jaw 15 being shown in this position in FIGS. 1 and 3, and a releasing position in which the jaw 15 is tilted forwardly, FIGS. 2 and 6 showing this position. Preferably, abutments limit the tilting of the jaw beyond each of these two positions. These abutments can be manifested, for instance, by the longitudinal sides of the depression/bore 22. Any other abutment can also be used.

In order to facilitate the opening of the jaw 15 during its release, the axle 20 is located in the front portion of the jaw 15, in front of the wings 16, 17 and in front of the sole clamp 18. In another preferable manner, the lateral trailing surfaces of the wings 16, 17 and the beginning of the sole clamp 18 are inclined. In this manner, when the jaw 15 is released, a lateral or vertical force exerted by the boot tends to tilt the jaw 15 to its open position.

In order to facilitate the opening of the jaw 15, one can provide a spring, for example, a torsional spring, mounted on, or around, the axle 20. Such a spring is not shown in the drawing figures.

A rocker 25, having two arms, controls the opening of the jaw 15 in the manner of a latch. The rocker 25 is articulated about a transverse axis 26, in the form of a pin or axle, for example, borne by the body 27 of the release block.

In the position for retaining the jaw shown in FIG. 3, the rocker 25 retains the jaw 15 by its upper arm 28. The arm is oriented such that the support of the jaw 15 generates a force component that passes by the axle 26 so that the rocker functions in the manner of a latch. The length of the arm 28 is determined so as to lock the jaw 15 in its adjusted retaining position while preventing its forward tilting.

Figure 5:
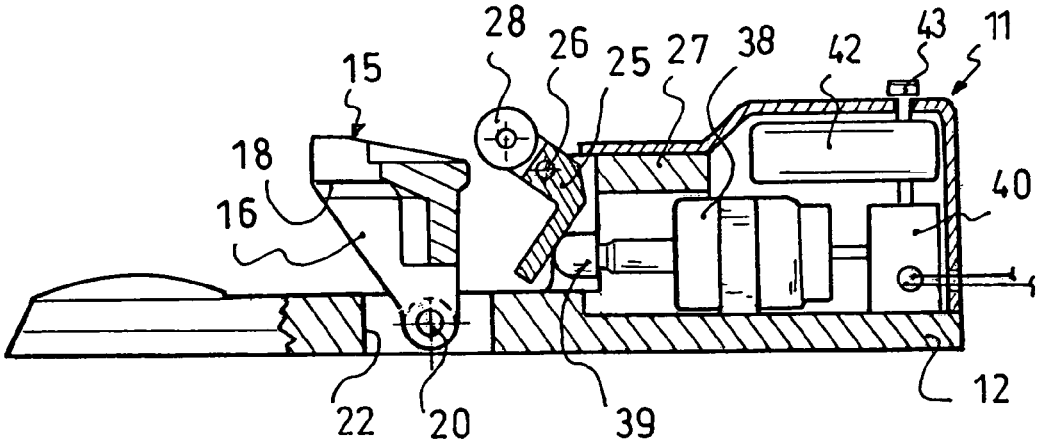
FIG. 5 shows the first jaw releasing phase.

In order to release the jaw 15, the arm 28 is titled upwardly about its axle 26, as shown in FIG. 5, whereby the arm 28 is moved from engagement with a surface for blocking the jaw 15 against movement to a boot-release position, to disengagement with such surface for unblocking the jaw, thereby allowing movement of the jaw 15 to the boot-release position. The jaw 15 thus released has the possibility of titling forwardly by being engaged under the arm 28, as shown in FIG. 6.

One can provide an abutment, for example, originating from the body, to limit the tilting movement of the arm 28.

Preferably, as shown in the drawing figures, the end of the arm 28 bears a roller for contact with the jaw 15.

The rocker 25 is elastically returned to its position for retaining the jaw 15 by a torsional spring 30 that is located in the area of the axle 26, and it is maintained in this position by an abutment originating, for example, from the body 27.

The movement of the rocker 25 in its position for releasing the jaw is itself controlled by an air cylinder/jack 38, whose rod 39 is provided to come into contact with the lower arm 35 of the rocker 25.

The body of the air cylinder/jack 38 is affixedly attached to the plate 12. Its rod is movable between a retracted position shown in FIG. 3 and an extended position shown in FIG. 5. In the retracted position, the rod exerts no action on the rocker 25 that is itself in the position for retaining the jaw 15 under the action of the return spring 30. In the extended position, the rod 39 pushes the arm 35 back in order to tilt the rocker 25 into its releasing position.

The cylinder/jack preferably has an inner spring that returns the rod to the retracted position.

The extension of the rod is controlled by a solenoid valve 40 that is controlled by an electronic processing circuit that is described below.

The solenoid valve is connected to a reservoir 42 containing a pressurized gas, for example, air or any other appropriate gas. This reservoir can be filled with pressurized gas by means of a cap 43.

The releasing block functions in the following manner. When the boot is engaged, the jaw 15 is maintained in the retaining position by the rocker; the skier engages the boot in the front jaw 15 and immobilizes the boot 2 on the ski 1 by means of the rear retaining block 6.

In order to release the boot, an electric impulse is sent to the solenoid valve 40 that sends a quantity of pressurized gas through the cylinder/jack 38, the cylinder rod pushes the rocker 25 back to its releasing position. The jaw 15 can then tilt forwardly, thus releasing the boot 2. When the electric signal is ended, the solenoid valve positions the active chamber of the cylinder in the open air, and the cylinder rod is returned to the retracted position by the spring 30.

It then suffices to tilt the jaw 15 in its retaining position so that the rocker 25 returns to its retaining position under the action of the spring 30. As an alternative, one could provide a ramp between the rocker 25 and the jaw 15 so that once the cylinder rod is retracted, the rocker 25 returns the jaw 15 to the closed position under the action of its return spring 30.

Figure 7:
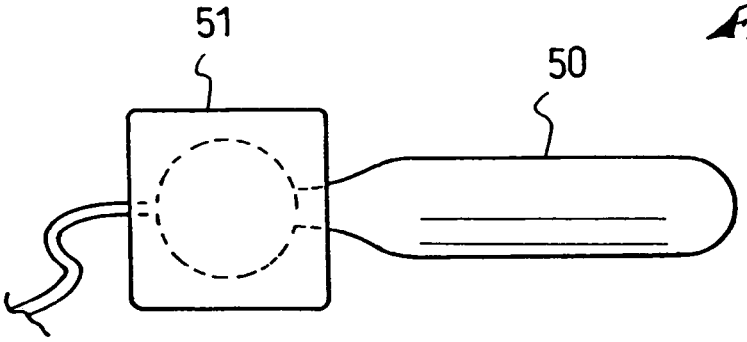
FIG. 7 shows an alternative embodiment.

Other alternative constructional embodiments could be used for the release block. For instance, as shown in FIG. 7, one could use a gas cartridge connected to a pressure regulator 51 instead of the reservoir 42. The cartridge contains high pressure gas, and the pressure regulator delivers low pressure gas to the solenoid valve and to the cylinder. In addition, this pressure is constant, such that the pressure drop in the cartridge throughout the releases does not affect the release conditions. When the cartridge pressure decreases below a predetermined value, it is replaced with a new cartridge. The cartridge 50 can be of the same type as the gas cartridges used for sports shooting weapons, extinguishers, or aerosol cans for inflating tires.

Such a gas cartridge enables a skier to obtain more than 50 successive releases.

One can also use another method for constructing the rocker 25 that controls the opening of the jaw 15.

The electrical impulse that controls the opening of the jaw 15 originates from a module 52 for analyzing and processing the forces/stresses between the boot 2 and the ski 1.

Figure 8:
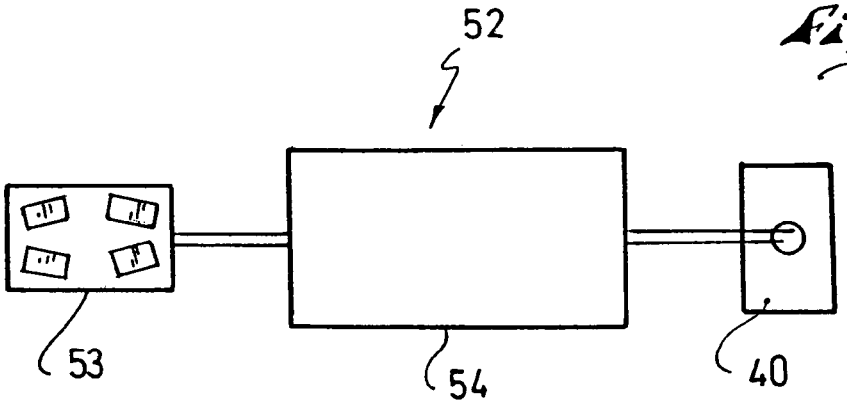
FIG. 8 shows an alternative embodiment.

The module 52 is shown schematically in FIG. 8.

It has a stress detector 53 that delivers one or several signals relative to the forces between the boot and the ski. This detector is formed, for example, by an assembly of stress gauges arranged on a plate in an arrangement capable of reacting to the stresses between the boot and the ski.

Figure 9:
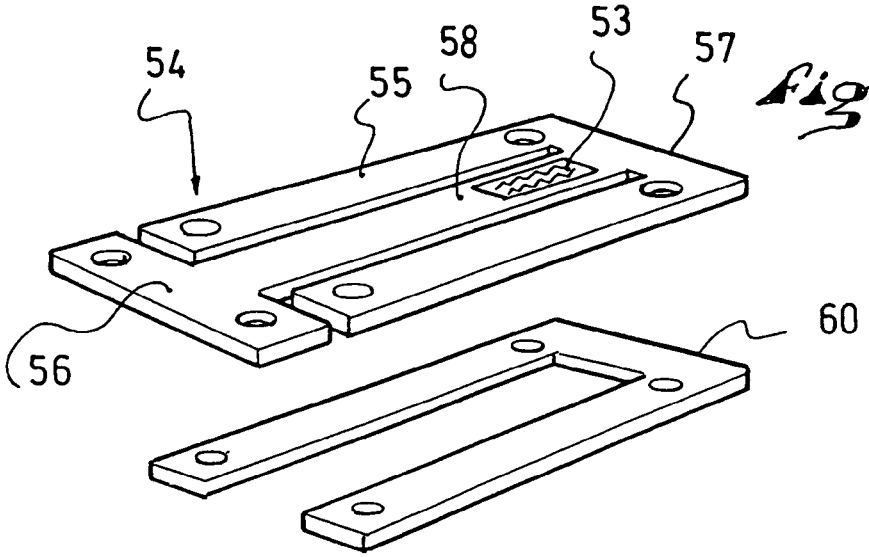
FIG. 9 is a perspective view of the releasing block support.

FIG. 9 shows a method for assembling the stress gauges. The detector is arranged on a plate 54 for supporting the release block.

The plate has a first U-shaped portion that is provided to be affixedly attached to the ski by any suitable means, for example, screws.

A second T-shaped portion 56 is connected to the base 57 of the first portion, with a median arm 58 engaged between the two lateral arms 55 of the first portion, and an upper transverse arm that in particular supports the zone of the retaining block on which the boot rests. The retaining block is affixedly connected to this second portion by any suitable means, such as screws.

The second portion is kept raised with respect to the upper surface of the ski. According to the embodiment shown, a U-shaped support, or wedge, 60 is positioned under the first portion of the plate 54.

The detector 53 is located at the base of the median arm 58 that is a bending zone in which the deformations of the plate resulting from the stresses exerted by the boot on the ski occur.

It is thus possible to detect a lateral force, a vertical force or a torsional bias of the boot. The stress gauges are arranged on their plate so as to react to these various stresses.

In an alternative embodiment, the support/wedge 60 and the plate could be unitary, or any other means could be used to keep the second T-shaped portion 56 raised.

The detector 53 is connected to a processing circuit 54. This circuit analyzes the signals originating from the detector 53 and compares them to a release threshold. When the release threshold is reached, the processing circuit sends to the solenoid valve 40, for a predetermined duration, a release signal that causes the extension of the cylinder 38.

The processing of the signal originating from the detectors is obtained by any suitable means. For instance, the processing can involve parameters such as the intensity of the signal and the duration, as described in published applications FR 2 363 343 and No. 2 351 678, and their family members, U.S. Pat. No. 4,191,395 and U.S. Pat. No. 4,160,555, respectively, commonly owned with the instant application. Other means for processing the signal can also be used.

Thus, for the retaining assembly of the invention, only the processing circuit requires a source of electrical power supply. The processing circuit consumption is relatively low, consequently a small battery is sufficient. The energy that controls the release block is of the pneumatic type, with the exception of any other source, particularly electrical or mechanical. This pneumatic energy has the advantage of being able to provide substantial power under light volume and weight.

The invention is not limited to the particular embodiment that has just been described, and alternative embodiments are possible.

Specifically, instead of the release block retaining the front of the boot, it would be possible to position it at the rear, or to position a block at the front and a block at the rear. In addition, the jaw could retain other members for fastening the boot than its front and rear end pieces. For instance, this could be blocks that project with respect to the boot sole, or a plate attached to the boot sole, or any other suitable means.

Another possibility would be to house the air reserve and the mechanism for releasing the boot in the boot sole.

According to another alternative, the functioning method of the cylinder and of the solenoid valve is reversed. In other words, the cylinder is maintained in the retracted position by the pressurized gas. In the case of release of the boot, the solenoid valve lets gas escape, and the cylinder rod goes to an extended position under the action of its return spring.

Other alternatives are also possible.

Finally, the invention is not limited to an alpine ski. It can be applied to all gliding or rolling apparatuses in which the boot is retained on the apparatus in a releasable manner.

What is claimed is:

1. An assembly for retaining a boot on a gliding board, said assembly comprising:

a release block having at least one jaw for retaining a member for fastening the boot;

the jaw being mounted for movement between a closed position for retaining the fastening member and an open position for releasing the fastening member;

a movable latch for maintaining the jaw in the closed position;

a source of pneumatic energy for controlling movement of the latch, said source of pneumatic energy comprising a reservoir containing a pressurized gas;

the latch being movable between a blocking Dosition and an unblocking position, wherein:

in the blocking position, the latch blocks movement of the jaw to the open position;

in the unblocking position, the latch releases the jaw for movement to the open position, the latch not forcing movement of the iaw to the open position.

2. An assembly according to claim 1, further comprising a solenoid valve connected to the reservoir of pressurized gas for delivering the pneumatic energy for controlling movement of the latch.

3. An assembly according to claim 2, further comprising a pressure regulator is positioned at an outlet of the gas reservoir.

4. An assembly according to claim 1, further comprising an air cylinder or jack controlled by said source of pneumatic energy positioned for tilting the movable latch for allowing opening of the jaw.

5. An assembly according to claim 1, wherein the latch is a rocker movable about an axle with an upper arm oriented in a position for closing the jaw, so that the force component passes through the axle for rotating the rocker.

6. An assembly according to claim 5, wherein the latch is elastically returned to the position for closing the jaw by a spring.

7. An assembly according to claim 1, wherein;

the latch is movable between a blocking position and an unblocking position:

in the blocking position, the latch blocks movement of the jaw to the open position;

in the unblocking position, the latch allows movement of the jaw to the open position;

in moving from the blocking position to the unblocking position, the latch is movable from a position in engagement with a surface to block movement of said jaw to a position spaced from said surface.

8. An assembly for retaining a boot on a gliding board, said assembly comprising:

a release block having at least one jaw for retaining a member for fastening the boot;

the jaw being mounted for movement between a closed position for retaining the fastening member and an open position for releasing the fastening member;

a movable latch for maintaining the iaw in the closed position;

a source of pneumatic energy for controlling movement of the latch, said source of pneumatic energy comprising a reservoir containing a pressurized gas;

a plate supporting said release block, said plate adapted to be positioned between the boot and the gliding board, said plate comprising:

a first portion having a pair of arms and a base extending between respective ends of said arms; and a second portion having a median arm connected to said base of said first portion and extending between said pair of arms of said first portion.

9. An assembly according to claim 8, wherein:

said control system further comprises a stress detector for detecting forces between the boot and the gliding board during use of the gliding board, said stress detector being mounted on said median arm of said second portion of said plate.

10. An assembly for retaining a boot on a gliding board, said assembly comprising:

a release block having at least one iaw for retaining a member for fastening the boot;

the iaw being mounted for movement between a closed position for retaining the fastening member and an open position for releasing the fastening member;

a movable latch for maintaining the iaw in the closed position:

a source of pneumatic energy for controlling movement of the latch, said source of pneumatic energy comprising a reservoir containing a pressurized gas;

a plate supporting said release block, said plate adapted to be positioned between the boot and the gliding board, said plate comprising:

a U-shaped first portion having a pair of arms extending longitudinally along a length of said assembly and adapted to extend along a length of the gliding board, said U-shaped first portion further having a base extending transversely between respective ends of said arms; and a T-shaped second portion having a median arm connected to said base of said U-shaped first portion and extending longitudinally between said pair of arms of said U-shaped first portion, said T-shaped second portion further having a transverse arm connected to said median arm.

11. An assembly according to claim 10 wherein the median arm of said second T-shaped portion of said plate includes a bending zone in which stress gauges are positioned.

12. An assembly according to claim 11, wherein a support is positioned under the plate to raise the bending zone.

13. An assembly according to claim 11, further comprising a solenoid valve connected to the reservoir of pressurized gas for delivering the pneumatic energy for controlling movement of the latch, wherein a processing circuit connects the stress gauges to the solenoid valve and delivers to the solenoid valve a signal for opening the jaw.

14. An assembly according to claim 10, wherein:

said control system further comprises a stress detector for detecting forces between the boot and the gliding board during use of the gliding board, said stress detector being mounted on said median arm of said T-shaped second portion of said plate.

15. An assembly for retaining a boot on a gliding board, said assembly comprising:

at least one jaw for engagement with a portion of the boot to retain the boot on the gliding board;

the jaw being mounted for movement between a boot-retaining position and a boot-releasing position;

a movable latch for controlling movement of the jaw from the boot-retaining position to the boot-releasing position, said movable latch being movable between a position blocking movement of the jaw to the boot releasing position and a position allowing release of the jaw to the boot-releasing position;

a control system for moving the movable latch to said position allowing release of the jaw to the boot-releasing position, said control system comprising:

a source of non-pyrotechnic pneumatic energy, said source of non-pyrotechnic pneumatic energy comprising a reservoir of pressurized gas;

a gas-actuated jack operatively connected to said movable latch;

a solenoid valve operatively interposed between said reservoir of pressurized gas and said iack for controlling actuation of said jack for movement of said movable latch;

a pressure regulator positioned between said reservoir of pressurized gas and said solenoid valve.

16. An assembly according to claim 15, wherein:

said control system further comprises a module for detecting, analyzing, and processing forces between the boot and the gliding board during gliding and for sending a control signal to said solenoid valve for movement of said movable latch upon detection of a boot release threshold by said module.

17. An assembly according to claim 16, further comprising:

a plate adapted to be mounted on the gliding board, at least said jaw of the assembly being supported by said plate, said plate having a bending zone;

wherein said module comprises stress gauges positioned in said bending zone of said plate for detecting said forces between the boot and the gliding board.

18. An assembly according to claim 16, further comprising:

a support positioned beneath said plate adapted to raise said bending zone of said plate above an upper surface of the gliding board.

19. An assembly according to claim 15, wherein:

the assembly comprises a front binding and a rear binding;

said jaw comprises part of said front binding, said jaw comprising a pair of lateral wings for lateral retention of the front end of the boot and a sole clamp for vertical retention of the front end of the boot;

said rear binding comprises a jaw for retaining a rear of the boot.

20. An assembly according to claim 15, wherein:

in moving from the blocking position to the position allowing movement of the jaw to the boot-releasing position, the latch is movable from a position in engagement with a surface blocking movement of said jaw to a position spaced from said surface.

21. An assembly for retaining a boot on a gliding board, said assembly comprising:

a boot-retaining block having at least one jaw to engage a portion of the boot to retain the boot on the gliding board;

the jaw being mounted for movement between a boot-retaining position and a boot-releasing position;

a movable latch for controlling movement of the jaw from the boot-retaining position to the boot-releasing position;

a control system for moving the movable latch to a position whereby the jaw assumes the boot-releasing position, said control system comprising a source of pneumatic energy;

a plate supporting said boot-retaining block and adapted to be positioned between the boot and the gliding board;

said plate comprising:

a U-shaped first portion having a pair of arms and a base extending transversely between respective ends of said arms; and a T-shaped second portion having a median arm having a first end connected to said base of said U-shaped first portion, said median arm extending between said pair of arms of said U-shaped first portion, said T-shaped second portion further having a transverse arm connected to a second end of said median arm.

22. An assembly according to claim 21, wherein:

said control system further comprises a stress detector for detecting forces between the boot and the gliding board during use of the gliding board, said stress detector being mounted on said median arm of said T-shaped second portion of said plate.

23. An assembly according to claim 22, further comprising:

a support positioned under said plate for raising said median arm of said T-shaped second portion of said plate, said median arm comprising a bending zone, said stress detector being mounted in said bending zone.

24. An assembly according to claim 23, wherein:

said source of pneumatic energy comprises a reservoir containing a pressurized gas;

said control system further comprises:

a gas-actuated jack operatively connected to said movable latch;

a solenoid valve operatively interposed between said reservoir of pressurized gas and said gas-actuated jack for controlling actuation of said jack for movement of said movable latch;

a processing circuit operatively interposed between said stress detector and said solenoid valve for delivering a signal to said solenoid valve to actuate said gas-actuated jack to allow movement of said jaw to the boot-releasing position.

25. An assembly according to claim 24, wherein:

said control system further comprises a pressure regulator positioned between said reservoir of pressurized gas and said solenoid valve.

26. An assembly according to claim 21, wherein:

said source of pneumatic energy comprises a source of non-pyrotechnic pneumatic energy.

27. An assembly according to claim 21, wherein:

said control system further comprises:

a solenoid valve operatively connected between said source of pneumatic energy and said jaw;

a module for detecting, analyzing, and processing forces between the boot and the gliding board during gliding and for sending a control signal to said solenoid valve for movement of said movable latch upon detection of a boot release threshold by said module.

28. An assembly according to claim 21, wherein:

said jaw comprises a pair of lateral wings for lateral retention of the front end of the boot and a sole clamp for vertical retention of the front end of the boot.

29. An assembly according to claim 21, wherein:

said pair of arms of said U-shaped first portion of said plate extend longitudinally along a length of said assembly and are adapted to extend along a length of the gliding board.

* * * * *